US008646524B2

(12) United States Patent
Al-Buraik

(10) Patent No.: US 8,646,524 B2
(45) Date of Patent: Feb. 11, 2014

(54) RECOVERING HEAVY OIL THROUGH THE USE OF MICROWAVE HEATING IN HORIZONTAL WELLS

(75) Inventor: Khaled Abdullah Al-Buraik, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 150 days.

(21) Appl. No.: 12/725,165

(22) Filed: Mar. 16, 2010

(65) Prior Publication Data

US 2011/0005748 A1 Jan. 13, 2011

Related U.S. Application Data

(60) Provisional application No. 61/160,441, filed on Mar. 16, 2009.

(51) Int. Cl.
*E21B 36/00* (2006.01)

(52) U.S. Cl.
USPC ..... 166/248; 166/302

(58) Field of Classification Search
None
See application file for complete search history.

(56) References Cited

U.S. PATENT DOCUMENTS

| | | | | |
|---|---|---|---|---|
| 3,133,592 A | | 5/1964 | Tomberlin | |
| 3,170,519 A | | 2/1965 | Haagensen | |
| 4,140,180 A | * | 2/1979 | Bridges et al. | 166/248 |
| 4,193,448 A | | 3/1980 | Jeambey | |
| RE30,738 E | | 9/1981 | Bridges et al. | |
| 4,638,863 A | | 1/1987 | Wilson | |
| 4,700,716 A | * | 10/1987 | Kasevich et al. | 607/156 |
| 5,082,054 A | * | 1/1992 | Kiamanesh | 166/248 |
| 5,318,124 A | | 6/1994 | Ong et al. | |
| 5,553,666 A | * | 9/1996 | Hartman | 166/60 |
| 5,621,844 A | | 4/1997 | Bridges | |
| 5,751,895 A | | 5/1998 | Bridges | |
| 5,784,530 A | | 7/1998 | Bridges | |
| 6,012,520 A | | 1/2000 | Yu et al. | |
| 6,189,611 B1 | * | 2/2001 | Kasevich | 166/248 |
| 7,109,457 B2 | * | 9/2006 | Kinzer | 219/770 |
| 7,147,057 B2 | | 12/2006 | Steele et al. | |
| 7,367,399 B2 | | 5/2008 | Steele et al. | |
| 7,398,823 B2 | | 7/2008 | Montgomery et al. | |
| 7,441,597 B2 | | 10/2008 | Kasevich | |

(Continued)

FOREIGN PATENT DOCUMENTS

| | | |
|---|---|---|
| WO | 0057021 A1 | 9/2000 |
| WO | 2007147053 A2 | 12/2007 |
| WO | WO 2009/064501 A1 | 5/2009 |

OTHER PUBLICATIONS

International Search Report dated Sep. 29, 2010; International Application No. PCT/US2010/027382.

*Primary Examiner* — Angela M DiTrani
*Assistant Examiner* — Silvana Runyan
(74) *Attorney, Agent, or Firm* — Bracewell & Giuliani LLP

(57) ABSTRACT

A process to enhance secondary recovery of underground formations having heavy hydrocarbons through the use of a horizontal source well and a producing well. The horizontal source well is equipped with a plurality of microwave source emitters and the producing well is equipped with an artificial lift system. The horizontal source well is positioned within close proximity to the underground hydrocarbon formation and microwave energy is emitted from the microwave source emitters into the underground hydrocarbon formation. The microwave radiation heats up the heavy hydrocarbons, thereby lowering their viscosity, which allows the hydrocarbons to more easily flow into the producing well.

15 Claims, 2 Drawing Sheets

(56) References Cited

U.S. PATENT DOCUMENTS

2006/0283598 A1 12/2006 Kasevich
2007/0131591 A1 6/2007 Pringle
2008/0073079 A1 3/2008 Tranquilla et al.
2008/0264934 A1 10/2008 Moreira et al.

* cited by examiner

RECOVERING HEAVY OIL THROUGH THE USE OF MICROWAVE HEATING IN HORIZONTAL WELLS

RELATED APPLICATION

This application claims priority to U.S. Provisional Application Ser. No. 61/160,441 filed Mar. 16, 2009.

FIELD OF THE INVENTION

The present invention relates to a method of extracting and recovering subsurface sour crude oil deposits. More specifically, the method employs the use of microwave radiation and permeability enhancement of reservoir rocks due to fracture by selective heating and creation of critical and supercritical fluids in the subsurface area.

BACKGROUND OF THE INVENTION

Much of the remaining crude oil resources are heavy oil or tar, both of which can also contain increased amounts of deleterious components such as sulfur. The low mobility of this oil makes its production difficult without some external stimulation such as heat. The most widely used method of thermal oil recovery is steam injection. A well-designed steam injection project is very efficient in recovering oil, however, its applicability is limited in many situations. Field performance and simulation studies have shown that very deep reservoirs, small thickness of the oil-hearing zone, higher reservoir pressures and reservoir heterogeneity detrimentally impact the performance of steam injection to a significant extent.

There are various technologies available to extract heavy oil. These technologies differ in several important ways: cold (ambient temperature) vs. thermal processes. Examples of cold production processes for viscous heavy oil and oil sands include: conventional production, water flooding, cold heavy oil production with sand (CHOPS), solvent injection, water injection alternating with gas injection (WAG), inert gas injection, and pressure pulsing. Examples of thermal production processes for viscous heavy oil include: steam flooding, cyclic steam stimulation (CSS), steam assisted gravity drainage (SAGD), and underground combustion.

As highlighted above, a variety of enhanced oil recovery methods have been developed and applied to mature and depleted reservoirs in order to improve the efficiency of recovery methods. The processes involved with heavy oil production often require excessive external water supplies for maintaining water pressure as well as steam generation, washing, and other steps. Management and disposal of the wastewater presents challenges and costs for the operators. In addition, production of heavy oil requires a substantial amount of energy for removing the heavy oil from the ground, processing it, and transporting it off-site.

SUMMARY OF THE INVENTION

Accordingly, a need has arisen for a process that can efficiently and economically produce heavy oil without the need for large amounts of water, energy, or solvents. Embodiments of the present invention satisfy at least one of these needs. A process for recovery heavy oil through the use of microwave heating in horizontal wells is provided. In one embodiment of the present invention, the process includes the steps of positioning an antenna within a source well, wherein the source well comprises at least one horizontal branch that is generally horizontal in orientation. Additionally, the horizontal branch is located in close proximity to an underground formation, with the underground formation having heavy hydrocarbons. The antenna includes source emitters spaced along the axially length of the antenna. The source emitters emit microwave energy into the underground hydrocarbon formation such that a microwave energy field is defined and such that the viscosity of substantially all of the heavy hydrocarbons within the microwave energy field is reduced. At least a portion of the heavy hydrocarbons from the underground hydrocarbon formation are removed through a horizontal branch of a producing well. The producing well is located below and adjacent and in fluid communication with the underground formation. The heavy hydrocarbons are then recovered from the producing well with the assistance of an artificial lift system. In one embodiment, the microwave energy is emitted at a frequency within the range of 300 MHz to 300 GHz.

In a further embodiment of the present invention, a second antenna is positioned within a second source well. The second source well includes at least one horizontal branch that is generally horizontal in orientation. This horizontal branch is also located in close proximity to the underground formation. Preferably, this second horizontal branch is parallel to the horizontal branch from the other source well. The second antenna also includes a plurality of source emitter spaced along the axially length of the second antenna. The present invention also encompasses embodiments having a plurality of source wells, wherein each source well has a horizontal branch that is in proximity to the underground formation.

In another embodiment, the artificial lift system is an electronic submersible pump (ESP). In additional embodiments, the entire process is conducted in the absence of externally provided water and/or solvents. In one embodiment of the present invention, the antenna is positioned within the source well using a wireline. In a further embodiment, the source emitters are arranged along their respective antennas such that the source emitters are spaced evenly along the length of their respective source well, wherein the source wells are six to 14 kilometers in length.

In another embodiment, the antenna further includes an open ended waveguide and a parabolic reflector, wherein the antenna is operable to transmit a predetermined frequency in a predetermined direction. In a further embodiment, the antenna is electrically coupled to a central microwave generator powered from a location above the surface. In a further embodiment, the source well is coupled to the producing well, the temperature of the source well is monitored, and the frequency of the microwave energy is controlled such that the temperature within the producing well may be controlled in order to upgrade the heavy hydrocarbon in-situ, such that the heavy hydrocarbon upon recovery has an increased API gravity and reduced amounts of sulfur. In preferred embodiments, the heavy hydrocarbons are upgraded by visbreaking, coking, steam cracking, and combinations thereof.

In another embodiment, the process can also include increasing the permeability within the underground hydrocarbon formation by generating steam in-situ such that porous rock structures within the underground hydrocarbon formation fracture and allow the heavy hydrocarbons to more easily flow into the producing well.

In another embodiment, the source well is created using a surface launched drilling rig that is equipped to adjust the borehole position on the fly based upon geological information gathered during drilling. In another embodiment, the producing well is created using a surface launched drilling rig that is equipped to adjust the borehole position on the fly based upon geological information gathered during drilling.

In another embodiment, the process can optionally include injecting a quantity of water into the underground hydrocarbon formation.

In an additional embodiment of the present invention, catalyst may be injected into the underground formation in order to further increase the API gravity and reduce the sulfur levels of the heavy hydrocarbon within the underground formation. The catalysts used in the process can be powdered iron, charcoal on iron, palladium oxide-silica based material, calcium oxide, an alkali metal oxide catalyst, traditional hydrotreating catalysts and combinations thereof. The alkali metal is selected from groups VIA and VIIIA of the periodic table and can include at least one metal that is selected from the group consisting of iron, palladium, nickel, cobalt, chromium, vanadium, molybdenum, tungsten, and a combination of metals such as nickel-molybdenum, cobalt-nickel-molybdenum, cobalt-molybdenum, nickel-tungsten, and nickel-tungsten-titanium. The catalyst can be in the form of a nanocatalyst. Hydrogen can also be added into the underground formation to aid the hydrodesulfurization. A suitable catalyst for increasing the API gravity and reducing sulfur levels of heavy hydrocarbons is described in PCT Patent Application No. PCT/US08/12859 entitled "Microwave-Promoted Desulfurization of Crude Oil" and filed on Nov. 14, 2008, which is herein incorporated by reference in its entirety.

BRIEF DESCRIPTION OF THE DRAWINGS

So that the manner in which the above-recited features, aspects and advantages of the invention, as well as others that will become apparent, are attained and can be understood in detail, more particular description of the invention briefly summarized above may be had by reference to the embodiments thereof that are illustrated in the drawings that form a part of this specification. It is to be noted, however, that the appended drawings illustrate only preferred embodiments of the invention and are, therefore, not to be considered limiting of the invention's scope, for the invention may admit to other equally effective embodiments.

DETAILED DESCRIPTION OF THE EXEMPLARY EMBODIMENTS

This application claims priority to U.S. Provisional Application Ser. No. 61/160,441 filed Mar. 16, 2009.

Embodiments of the present invention utilize microwave energy to create a subterranean reactor that enhances secondary recovery by heating the heavy hydrocarbon within the underground formation thereby decreasing the viscosity of the heavy hydrocarbon within the underground hydrocarbon formation, which allows the hydrocarbons within the formation to more easily flow down into the producing well. This dielectric heating of water and hydrocarbons also generate fissures and controlled fracture zones in the underground formation, thereby improving permeability of the underground formation, which allows for improved gravitational flow recovery. Furthermore, embodiments of the present invention also allow for the use of an artificial lift system in order to more efficiently and effectively recover the heavy hydrocarbons from the underground hydrocarbon formation.

Figure 1:
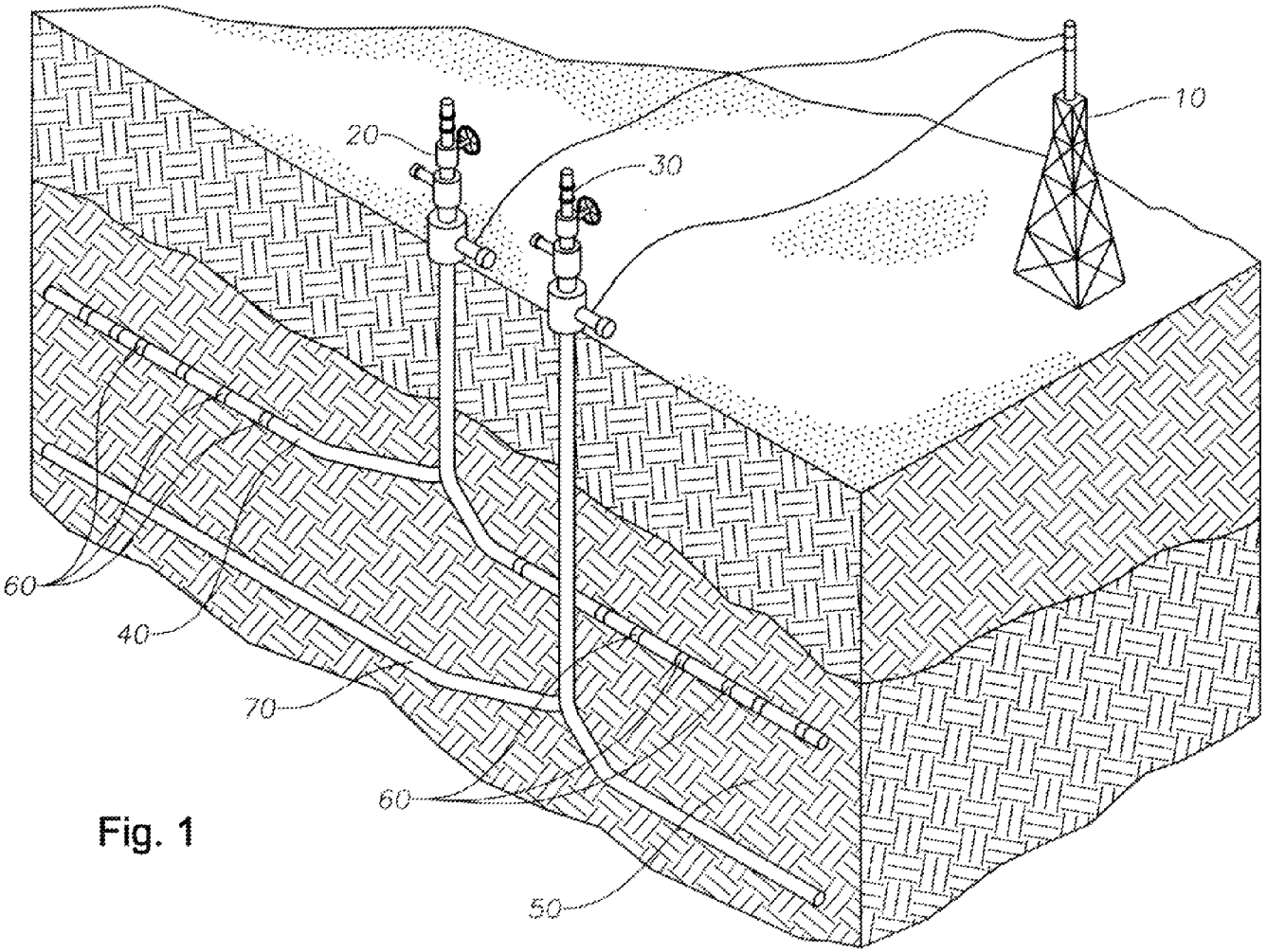
FIG. 1 shows one embodiment of the present invention.

FIG. 1 demonstrates one embodiment of such a system. Centralized power source 10 is electrically coupled to source well 20 and producing well 30. Source well 20 includes horizontal branch 40 that is substantially horizontal when compared to underground hydrocarbon formation 50. Preferably, horizontal branch 40 is located in close proximity to underground hydrocarbon formation 50. Horizontal branch 40 is equipped with an antenna (not shown), which is also electrically coupled to centralized power source 10. The Antenna includes a plurality of source emitters 60 which are operable to direct microwave energy in a predetermined direction such that a microwave energy field is defined. The microwave energy penetrates into underground hydrocarbon formation 50 and heats the hydrocarbons within the microwave energy formation, thereby reducing the viscosity of the heavy hydrocarbons, which allows the heavy hydrocarbons to more easily flow into horizontal branch 70 of producing well 30. Producing well 30 is also equipped with an artificial lift system (not shown), which aides in the recovery of the heavy hydrocarbons to the surface. In a preferred embodiment, the artificial lift system is an electronic submersible pump (ESP) that is electrically coupled to centralized power source 10.

In another embodiment, the present invention can also include a plurality of source wells that each have a plurality of horizontal branches such that the resulting microwave energy field encompasses a larger volume of the underground hydrocarbon formation 50. An advantage of horizontal boring minimizes environmental disruption while maximizing potential proximity to underground hydrocarbon formation 50. The additional horizontal branches ensure a more thorough coverage area within underground formation 50 for maximum sweepage. In an embodiment with many horizontal branches, a maximum reservoir contact can be established.

Figure 2:
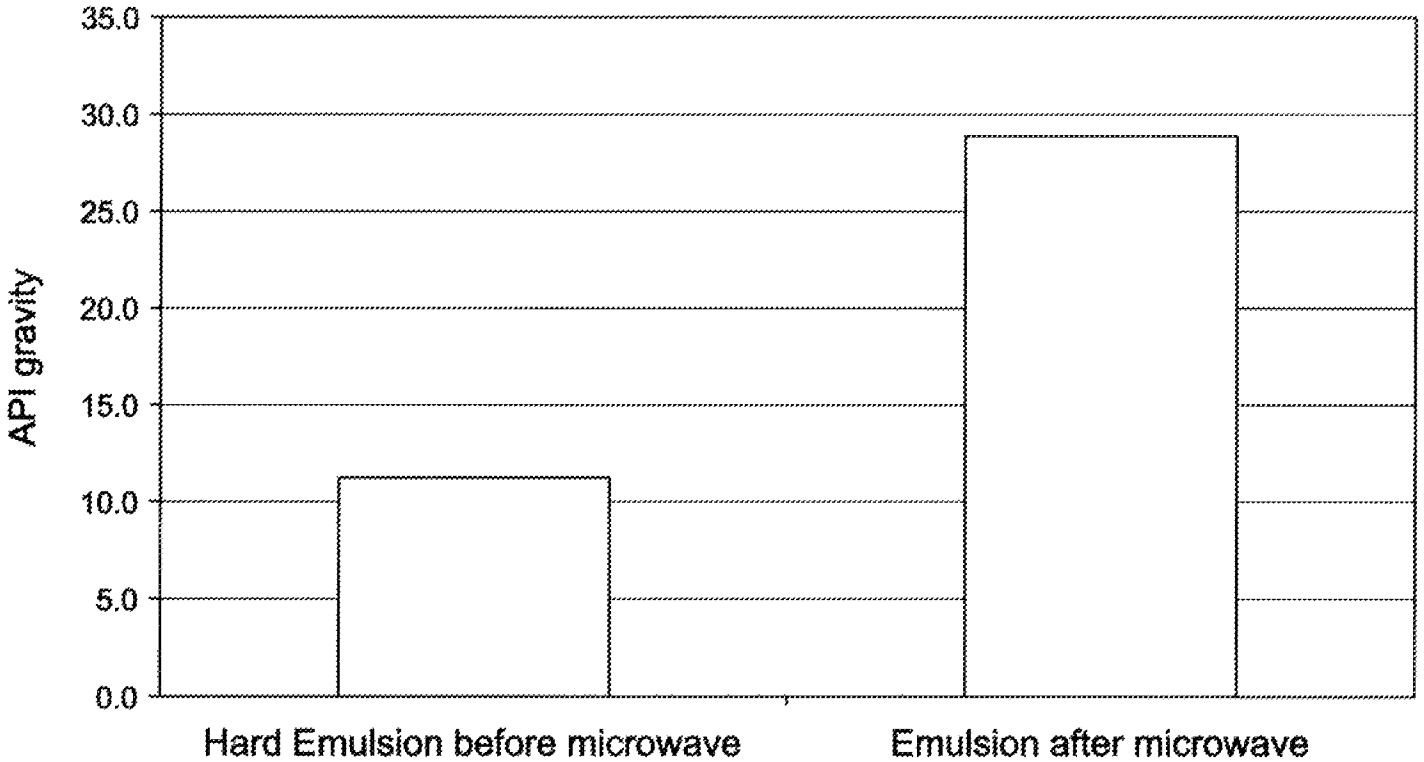
FIG. 2 shows a graphical representation of the advantages of the present invention.

FIG. 2 is a graphical representation showing the advantageous results of using the process of the present invention. As shown in FIG. 2, the API gravity of the heavy oil prior to treatment was approximately 11 degrees. However, following the process of the present invention, the API gravity of the oil was increased to approximately 29 degrees.

An embodiment of the present invention provides a system and method to apply microwave energy to in-situ heavy hydrocarbons to heat the hydrocarbons and other materials in their vicinity. This system and method enhance the recovery of the heavy hydrocarbons. At the same time, it may be used to upgrade the heavy hydrocarbons in-situ. Heavy hydrocarbons have high viscosities and pour points, making them difficult to recover and transport. Microwave based heating, with the presence of dielectric materials such as water, however, lowers the viscosity, pour point, and specific gravity of the hydrocarbon, rendering it easier to pump by an ESP to recover and handle.

Another improvement in this invention is the use of ESP. By decreasing the pressure at the bottom of the well significantly more oil can be produced from the producing well compared to natural production based on gravity. The ESP should be operable to operate at wells greater than 15,000 ft, at temperature over 220 deg C., and operate at production ranging from 100 bbl/day to 100,000 bbl/day. Ideally, ESP components would also provide monitoring systems, surface electrical equipment to provide an optimum lift system for the well and optimize pump and well performance while reducing operating costs. An example of a preferred ESP is the REGA ESP marketed by Schlumberger.

In one embodiment, the ESP includes many components: a staged series of centrifugal pumps to increase the pressure of the well fluid and push it to the surface. In one embodiment, the energy to turn the pump can come from a high-voltage alternating-current source to drive a special motor that can work at high temperatures of up to 300° F. (150° C.) and high pressures of up to 5000 lb/in$^2$ (34 MPa), from deep wells deep with high energy requirements of up to about 1000 horsepower (750 kW). Given their high rotational speed of up to 4000 rpm (67 Hz) and tight clearances, these pumps are not tolerant of solids such as sand. Therefore, specialized ESP's are appropriate. In one embodiment, the proposed ESP's can be multiple stage submersible pumps. Maximus systems also offer Phoenix downhole gauges for real-time monitoring of ESP and reservoir performance. These are variable-rated for many operating conditions. Maximus motors offer flexibility across a wide range of applications. Multiphase pumps may be used in specific applications. In a further embodiment, the ESP(s) can be used to optimize the flow of hydrocarbons in the production well.

In another embodiment, the invention is further enhanced by the use of a steerable method for installing underground cables in a prescribed bore path by using a surface launched drilling rig, with minimal impact on the surrounding area. Horizontal boring minimizes environmental disruption. Pipes can be made of materials such as PVC, polyethylene, ductile iron, and steel if the pipes can be pulled through the drilled hole. In the process of drilling the horizontal well, Saudi Armco Geosteering Technology, the act of adjusting the borehole position on the fly to reach maximum contact with the underground hydrocarbon formation. These changes are based on geological information gathered while drilling, i.e., Measurement While Drilling (MWD). This technology could be used to determine the optimum or "minimum water" needed for effective performance. Horizontal wells are planned in advance to achieve specific goals based on 3d reservoir data regarding the underground hydrocarbon formation. A well plan is a continuous succession of straight and curve lines representing the geometrical figure of the expected well path which is used to develop the well. In this manner the use of MWE is optimized.

Microwave assisted horizontal wells are placed as many times as needed in the reservoir to cover the range of areas needed. Each source well and producing well has a certain impact on the reservoir region to heat the heavy hydrocarbon. In an embodiment of the present invention, the horizontal branches of the wells are six to 14 km in length.

In an embodiment of the present invention, with the application of microwave energy, a pressure gradient develops extending away from the subterranean reactor and thereby forces hot vapor from the underground hydrocarbon formation. At elevated power levels, high pressure steam would be generated which would not only crack the hydrocarbon molecules but would also generate cracks and fissures in the rock matrix in the underground hydrocarbon formation facilitating fluid flow. The temperature and pressure may be controlled to provide the desired pressure and temperature at which selected fluids become critical or super critical fluids. For example, methane is often present in the underground hydrocarbon formation and the pressure may be established at or above 45.4 atmospheres with a temperature at or above 190.4 K to create a critical or super critical fluid of the methane which acts as an organic solvent to enhance crude oil removal. The pressure and temperature may also be controlled to create a critical or super critical fluid of the water in the target area. The source well can be placed in proximity to and above the production well. The microwave energy could optionally be controlled to minimize coking and achieve the desired cracking and upgrading of the heavy hydrocarbon. The resulting products could then be recovered via the producing well and transferred to a storage and/or processing facility.

Having described the invention above, various modifications of the techniques, procedures, materials, and equipment will be apparent to those skilled in the art. While various embodiments have been shown and described, various modifications and substitutions may be made thereto. Accordingly, it is to be understood that the present invention has been described by way of illustration(s) and not limitation. It is intended that all such variations within the scope and spirit of the invention be included within the scope of the appended claims.

What is claimed is:

1. A process for enhancing the recovery of heavy hydrocarbons from an underground hydrocarbon formation through the use of microwave heating in horizontal wells, the process comprising the steps of:

positioning an antenna within a horizontal source well, wherein the source well comprises at least one horizontal branch that is generally horizontal in orientation, the horizontal branch located in close proximity to the underground hydrocarbon formation, the underground hydrocarbon formation comprising heavy hydrocarbons, the antenna comprising source emitters spaced along the axially length of the antenna, such that the source emitters are operable to transmit in a predetermined direction;

coupling the source well to the producing well using a system operable to monitor the temperature in the source well and to control the frequency of microwave energy in a producing well, where the producing well is located below and adjacent and in fluid communication with the underground formation;

emitting microwave energy from the source emitters in the predetermined direction into the underground hydrocarbon formation such that a microwave energy field is defined in the predetermined direction and such that the viscosity of substantially all of the heavy hydrocarbons within the defined microwave energy field in the predetermined direction is reduced;

monitoring the temperature within the source well;

controlling the frequency of the microwave energy such that the temperature within the producing well may be controlled in order to upgrade the heavy hydrocarbons in-situ;

removing at least a portion of the heavy hydrocarbons from the underground hydrocarbon formation through a horizontal branch of the producing well; and recovering the heavy hydrocarbons from the producing well with the assistance of an artificial lift system, where the heavy hydrocarbons have an increased API gravity and reduced amounts of sulfur.

2. The process of claim 1, further comprising positioning a second antenna within a second horizontal source well, wherein the second source well comprises at least one horizontal branch that is generally horizontal in orientation, the horizontal branch located in close proximity to the underground hydrocarbon formation, the second antenna comprising source emitters spaced along the axially length of the second antenna, such that the source emitters are operable to transmit in a second predetermined direction, and where the microwave energy field is defined at the intersection of the predetermined and the second predetermined directions.

3. The process of claim 1, wherein the artificial lift system comprises an electronic submersible pump.

4. The process of claim 1, wherein the process is conducted in the absence of externally provided water.

5. The process of claim 1, wherein the process is conducted in the absence of externally provided solvents.

6. The process of claim 1, wherein the step of positioning the antenna within the source well is accomplished using a wireline.

7. The process of claim 1, wherein the source emitters are arranged along the antenna such that the source emitters are spaced evenly along the length of the source well, wherein the source well is six to 14 kilometers in length.

8. The process of claim 1, wherein the antenna further comprises:

an open ended waveguide; and a parabolic reflector, wherein the antenna is operable to transmit a predetermined frequency in a predetermined direction.

9. The process of claim 1, wherein the antenna is electrically coupled to a central microwave generator powered from a location above the surface.

10. The process of claim 1 where the heavy hydrocarbon is upgraded in-situ via a method selected from the group consisting of visbreaking, coking, steam cracking, and combinations thereof.

11. The process of claim 1, further comprising increasing the permeability within the underground hydrocarbon formation by generating steam in-situ such that porous rock structures within the underground hydrocarbon formation fracture and allow the heavy hydrocarbons to more easily flow into the producing well.

12. The process of claim 1, wherein the source well is created using a surface launched drilling rig that is equipped to adjust the borehole position on the fly based upon geological information gathered during drilling.

13. The process of claim 1, further comprising injecting a quantity of water into the underground hydrocarbon formation.

14. The process of claim 1, wherein the microwave energy is emitted at a frequency within the range of 300 MHz to 300 GHz.

15. The process of claim 1 where the coupling of the source well to the producing well is through an electrical coupling.

* * * * *